US010687643B2

(12) United States Patent
Cheng

(10) Patent No.: US 10,687,643 B2
(45) Date of Patent: Jun. 23, 2020

(54) CONTAINER WITH FOLDABLE ELASTIC SPOUT

(71) Applicant: Zhejiang Haoda Science & Technology Co., Ltd, Jinhua (CN)

(72) Inventor: Haojun Cheng, Jinhua (CN)

(73) Assignee: Zhejiang Hoada Science & Technology Co., Ltd, Jinhua (CN)

( * ) Notice: Subject to any disclaimer, the term of this patent is extended or adjusted under 35 U.S.C. 154(b) by 24 days.

(21) Appl. No.: 16/198,757

(22) Filed: Nov. 21, 2018

(65) Prior Publication Data

US 2020/0093305 A1 Mar. 26, 2020

(30) Foreign Application Priority Data

Sep. 25, 2018 (CN) ..... 2018 1 1116597
Sep. 25, 2018 (CN) ..... 2018 2 1563085 U

(51) Int. Cl.
*A47G 21/18* (2006.01)
*A47G 19/22* (2006.01)

(52) U.S. Cl.
CPC ..... *A47G 21/185* (2013.01); *A47G 19/2272* (2013.01)

(58) Field of Classification Search
CPC .. A47G 21/185; A47G 21/18; A47G 19/2272; A47G 19/2266; B65D 25/2873; B65D 25/287; B65D 25/2835
USPC ..... 220/715, 714, 711, 709, 708, 706, 705, 220/754; 215/229, 388
See application file for complete search history.

(56) References Cited

U.S. PATENT DOCUMENTS 5,897,013 A * 4/1999 Manganiello ..... A47G 19/2266 215/229
8,191,727 B2 * 6/2012 Davies ..... A47G 19/2266 220/707
2002/0170874 A1 * 11/2002 Hou ..... A47G 19/2266 215/229
2012/0187075 A1 * 7/2012 El-Saden ..... B65D 47/066 215/389
2016/0296051 A1 * 10/2016 Lane ..... B65D 47/066
2017/0253395 A1 * 9/2017 Matthis ..... A47G 19/2272
2019/0183269 A1 * 6/2019 Kalisz ..... B65D 53/02

* cited by examiner

*Primary Examiner* — Robert J Hicks

(57) ABSTRACT

A container includes a lid and a container body connected to the lid, and the lid includes a lid body. The lid body is further provided an elastic spout extending away from the lid body and a limiting seat mounted at the top of the lid body; a linking part is mounted on the elastic spout, and a locking part cooperating with the linking part is disposed on the limiting seat; the elastic spout has a folded storage state, and the linking part and the locking part are interlocked with each other in the folded storage state; the elastic spout has a release state in which the linking part is disengaged from the locking part to enable the elastic spout to be unfolded. The assembly and operation of the container is simple. It is easy to use and clean, and the service life of the container may be extended.

13 Claims, 6 Drawing Sheets

CONTAINER WITH FOLDABLE ELASTIC SPOUT

CROSS-REFERENCE TO RELATED APPLICATIONS

This application claims all benefits accruing under 35 U.S.C. § 119 from China Patent Application Nos. 201811116597.0, filed on Sep. 25, 2018, and 201821563085.4, filed on Sep. 25, 2018, in the State Intellectual Property Office of China, the content of which is hereby incorporated by reference.

TECHNICAL FIELD

The present disclosure relates to daily necessities, in particular to a container.

BACKGROUND

In the prior art, a container with a spout is widely used. The container generally includes a lid and a container body connected to each other. The spout is inserted and fixed on the lid, and the lid of some containers is further provided with a flip cover. The spout is indirectly abutted by the movement of the flip cover, so that the spout is bent and folded. An interoperable locking mechanism may be arranged between the lid and the flip cover to maintain the folded or storage state of the spout. However, the flip cover is generally reset with a need of a metal spring. Thus, the structure is complicated and there is a potential hazard in hygiene and safety.

SUMMARY

In order to provide a container which is simple in structure, easy to clean, and convenient to use, an embodiment of the present disclosure includes a container, including a lid and a container body connected to the lid, the lid including a lid body, wherein the lid body is further provided with an elastic spout extending away from the lid body and a limiting seat mounted at the top of the lid body. A linking part is mounted on the elastic spout, and a locking part cooperating with the linking part is disposed on the limiting seat. The elastic spout has a folded storage state, and the linking part and the locking part are interlocked with each other in the folded storage state. The elastic spout also has a release state in which the linking part is disengaged from the locking part to enable the elastic spout to be unfolded.

Furthermore, the elastic spout is provided with a fixing sleeve rotatably mounted on the lid body, and the linking part is rotatably mounted on the fixing sleeve.

Furthermore, the limiting seat is provided with a slideway, the outer wall of the fixing sleeve is provided with a guiding shaft, and the guiding shaft is rotatably and slidably mounted in the slideway. The linking part is released from the locking part by the movement of the guiding shaft in the slideway.

Furthermore, two slideways are oppositely disposed, and two guiding shafts are respectively and slidably disposed in each of the slideways, and the two guiding shafts are disposed coaxially on both radial sides of the fixed sleeve.

Furthermore, the limiting seat is a U-shaped structure that is horizontally fixed on the top surface of the lid body, and includes a first sidewall, a second sidewall and a third sidewall. The first sidewall and the second sidewall are oppositely disposed, and the third sidewall is connected between the first sidewall and the second sidewall, the two slideways are respectively disposed adjacent to the first sidewall and the second sidewall, the locking part is disposed at the third sidewall, and the elastic spout is mounted within the enclosed area surrounded by the U-shaped structure.

Furthermore, on each of the first sidewall and the second sidewall are further provided with a positioning step, and the edge of the linking part is placed on the positioning step when the elastic spout is in the folded storage state.

Furthermore, the limiting seat and the lid body are separate structures and are capable of being fixed to each other. On each of the first sidewall and the second sidewall are further provided with a guiding slot engageable with the corresponding slideway for mounting the guiding shaft, the respective guiding slots extending to a portion where the sidewall intersects with the lid body.

Furthermore, the elastic spout includes a liquid inlet at one end and a liquid outlet at the other end. The one end with the liquid inlet is fixed to the lid body, the other end with the liquid outlet pierces through the fixing sleeve and an anti-off head subject to the fixed sleeve is disposed at the piercing portion.

Furthermore, the linking part is a cover plate, and the cover plate blocks the liquid outlet of the elastic spout when the elastic spout is in the storage state. The cover plate is provided with a force applying wrench for driving the cover plate and the locking part to release the interlocking state.

Furthermore, a rotation axis of the guiding shaft and a rotation axis of the linking part are parallel and offset from each other. The rotation axis of the linking part is closer to the liquid outlet of the elastic spout, compared to the rotation axis of the guiding shaft.

Furthermore, at least one section of the elastic spout is an elastic segment for driving the elastic spout to be unfolded, and the elastic segment closes the cavity by self-bending when the elastic spout is in the folded storage state.

Furthermore, one side of the fixing sleeve adjacent to the liquid outlet is a top edge and the anti-off head abuts the top edge. The other side of the fixing sleeve is a bottom edge. The elastic segment is bent around the bottom edge of the fixing sleeve and is tensioned in the storage state. The elastic segment of the tensioned state drives the linking part and the locking part to be in the interlocked state.

Furthermore, the locking part is a locking tongue that is abutted against the top surface of the linking part when being interlocked.

The container according to the present disclosure is configured to lock and release the elastic spout by providing cooperation between the linking part, the elastic spout and the limiting seat, so as to make the elastic spout of the container safer and more sanitary in assembly and operation. The container as a whole is easy to use and clean, and the service life of the container may be extended accordingly.

DETAILED DESCRIPTION

Figure 1:
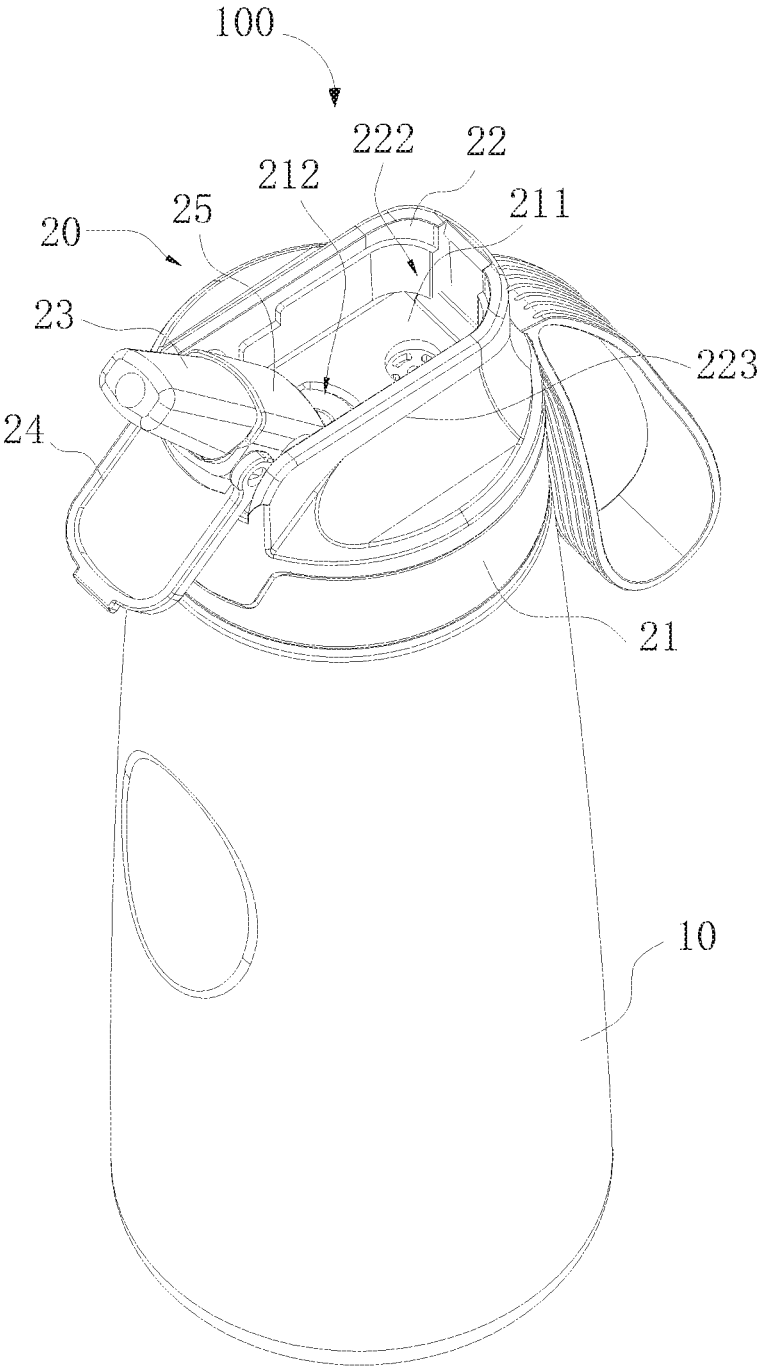
FIG. 1 is a perspective view of a container according to an embodiment of the present disclosure.

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

It should be noted that when an element is referred to as being "fixed" to another element, it may be directly attached to the other element or a further element may be presented between them. When an element is considered to be "connected" to another element, it may be directly connected to the other element or connected to the other element through a further element (e.g., indirectly connected). The terms as used herein "vertical", "horizontal", "left", "right", and the like, are for illustrative purposes only and are not meant to be the only orientation.

Unless otherwise defined, all technical and scientific terms used herein have the same meaning as a skilled person in the art would understand. The terminology used in the description of the present disclosure is for the purpose of describing particular embodiments and is not intended to limit the disclosure.

Referring to FIG. 1 to FIG. 6, embodiments of the present disclosure include a container 100 including a container body 10 and a lid 20 connected to the container body 10, wherein the lid 20 includes a lid body 21, a limiting seat 22, an elastic spout 23 and a linking part 24. The elastic spout 23 is inserted on the lid body 21. The limiting seat 22 is provided with a locking part 221 that cooperates with the linking part 24.

The container body 10 and the lid body 21 may be sealed and connected by ways of a threaded engagement or the like. The limiting seat 22 is located at the top of the lid body 21 and is fixedly mounted with the lid body 21, for example, by bonding or screwing. Alternatively, the limiting seat 22 and the lid body 21 are of a unitary structure.

The elastic spout 23 is arranged for draining the liquid in the container body 10. One end of the elastic spout 23 is connected to the lid body 21, for example, by sealing, clamping and the like, and may extend into the container body 10. Thus, one could drink liquid by tipping or sucking according to a need whether to extend or according to the length of extension. The other end of the elastic spout 23 includes a liquid outlet.

The linking part 24 is connected to the elastic spout 23. They may be directly connected or indirectly connected with each other, and not only in contact with each other. The linking part 24 and the elastic spout 23 may be fixedly connected. In other words, when one moves, the other one will follow. The linking part 24 may also be rotatably cooperated with the elastic spout 23. For example, a shaft 256 is directly or indirectly mounted on the elastic spout 23, and the linking part 24 is mounted on the elastic spout 23 through the shaft 256.

The elastic spout 23 may be deformed by itself, and thus may have a folded storage state. In the storage state, the linking part 24 and the locking part 221 are interlocked with each other. The elastic spout 23 further has an unfolded release state where the linking part 24 could be disengaged from the locking part 221 to enable the elastic spout 23 to be unfolded.

When the container 100 is not in use, in order to keep the elastic spout 23 in the storage state, the limiting seat 22 is provided with a locking part 221 that cooperates with the linking part 24, and the liquid outlet of the elastic spout 23 is limited in the lid body 21. When the user opens the linking part 24, the elastic spout 23 is reset by its own elastic force. Thus, the inside of the cavity is unblocked, and the liquid outlet is also turned up for the user to drink.

In one embodiment, the outer edge of the lid body 21 has a flange. The inner edge of the flange is provided with an internal thread and is connected to the container body 10 by a threaded engagement. It is understood that in other embodiments, the lid body 21 and the container body 10 may be connected by other means. For example, a corresponding boss is directly provided on the container body 10 and the lid body 21, and the connection is provided by snap fit. A gasket may be added at the joint between the container body 10 and the lid body 21 to increase the sealing property.

The lid body 21 serves as a base body for mounting the elastic spout 23 and the limiting seat 22. The top surface of the lid body 211 is provided with a through hole 212 for fixing and inserting the elastic spout 23. The inner wall of the through hole 212 extends along the axis of the lid body 21 to the direction of the container body 10 with a predetermined distance. The contact area with the elastic spout 23 is increased. The inner diameter of the through hole 212 is adapted to and is tightly connected to the elastic spout 23 to avoid liquid leakage at the joint.

Preferably, the top surface of lid body 211 further includes a vent hole 213 connected with the outside. When liquid is filled in the container 100, the vent hole 213 maintains the internal and external pressures consistently, so that the user may smoothly drain the liquid in the container 100 through the elastic spout 23.

In one of the embodiments, the outer side wall of the lid body 21 is provided with a protruding anti-slip pattern for enhancing the friction between the lid body and the user's hand, so that the user may easily unscrew the lid 20.

In one embodiment, one end of the elastic spout 23 is further sleeved with a fixing sleeve 25. The fixing sleeve 25 is rotatably mounted on the lid body 21, for example, and may be directly or indirectly mounted on the lid body 21. The linking part 24 is rotatably mounted on the fixing sleeve 25, and the fixing sleeve 25 is rotated to drive or enable the elastic spout 23 to fold.

The fixing sleeve 25 is made of a material having certain hardness, such as plastic, to drive or enable the elastic spout 23 to bend.

The fixing sleeve 25 is sleeved on the elastic spout 23. They may be of a unitary structure, or the fixing sleeve 25 may also be a separate structure. When the fixing sleeve 25 is a separate structure, individual portions of the separate structure are circumferentially arranged around the elastic spout 23 and fastened to each other. It is more convenient to assemble the fixing sleeve 25 in the separate structure.

Preferably, the liquid inlet of the elastic spout 23 is inserted into the lid body 21, and the liquid outlet of the elastic spout 23 pierces through the fixing sleeve 25. An anti-off head 233 which is limited by the fixing sleeve 25 is disposed at the piercing portion. The inner diameter of the anti-off head 233 is slightly larger than the inner diameter of the fixing sleeve 25 to prevent the liquid outlet from coming out of the fixing sleeve 25.

In one embodiment, one side of the fixing sleeve 25 adjacent to the liquid outlet is a top edge 254, and the anti-off head 233 abuts the top edge 254. The other side of the fixing sleeve 25 is a bottom edge 255. In the folded storage state, the elastic spout 23 is bent around the bottom edge 255 of the fixing sleeve 25 and is in a tension state. The elastic spout 23 in the tension state drives the linking part 24 and the locking part 221 to be in an interlocked state.

In one of the embodiments, the elastic segment 231 of the elastic spout 23 is between the top edge 254 and the bottom edge 255 of the fixing sleeve 25. The elastic segment 231 is cooperated with a location of the bottom edge 255 of the fixing sleeve 25.

In one embodiment, the fixing sleeve 25 is rotatably mounted around a first axis 251 on the lid body 21, and the rotation axis of a guiding shaft 253 is the first axis 251. The linking part 24 is rotatably mounted around a second axis 252 on the fixing sleeve 25, and the rotation axis of the linking part 24 is the second axis 252. The first axis 251 and the second axis 252 are parallel to each other. Preferably, the first axis 251 and the second axis 252 are arranged offset. Preferably, the second axis 252 is closer to the liquid outlet of the elastic spout 23, compared to the first axis 251.

In one of the embodiments, the limiting seat 22 is provided with a slideway 228 for guiding the movement path of the elastic spout 23 directly or indirectly. The slideway 228 may be two slideways which are oppositely arranged.

In one embodiment, the opposite sides of the outer wall of the fixing sleeve 25 is provided with a guiding shaft 253 extending into the slideway 228 of the limiting seat 22, and the rotation axis of the guiding shaft 253 is the first axis 251. The number of the guiding shafts 253 is the same as the number of the slideways 228. The guiding shaft 253 correspondingly extends into the respective slideways 228. Preferably, the number of the guiding shafts 253 is two, and the two guiding shafts 253 are coaxially arranged on both radial sides of the fixed sleeve 25. The fixing sleeve 25 is arranged for rotatably and slidably mounting the elastic spout 23 on the lid body 21. That is, the fixing sleeve 25 is rotatably mounted and slidably mounted on the limiting seat 22 which is connected to the lid body 21. During the unlocking or releasing process, the position of the first axis 251 is movable relative to the position of the slideway 228. The guiding shaft 253 is arranged to guide the sliding direction of the fixing sleeve 25, and to provide a pivot for the rotation of the fixing sleeve 25 with respect to the lid body 21.

Preferably, the limiting seat 22 is a U-shaped structure 222 that is horizontally fixed on the top of the lid body 21. The limiting seat 22 includes a first sidewall 223 and a second sidewall 224 which are oppositely disposed, and a third sidewall 225 which is connected between the first sidewall 223 and the second sidewall 224. The limiting seat 22 is horizontal, which may be understood as the opening direction of a U-shape is the radial direction of the container body 10 (or the lid body 21). That is, the opening direction of the U-shape has a substantially horizontal orientation in a normal state.

The slideways 228 are respectively disposed adjacent to the first sidewall 223 and the second sidewall 224, and the elastic spout 23 is installed in the area surrounded by the U-shaped structure 222, i.e., the storage area 226. A portion of the elastic spout 23 may be placed in the slideway 228, or the guiding shaft 253 of the fixing sleeve 25 on the elastic spout 23 may be inserted into the slideway 228. By the above manner, the slideway 228 may be used to define the movement path of the elastic spout 23. At least the movement path of local position of the elastic spout 23 may be defined, so that the elastic spout 23 is bent according to a predetermined axis portion when switching between the storage state and the release state. Furthermore, the angle of the bending may be defined.

Preferably, the third sidewall 225 is provided with a locking part 221 for fastening with the linking part 24. The linking part 24 cooperates with the locking part 221 to take in the elastic spout 23 in the storage area 226 of the limiting seat 22. Preferably, the locking part 221 is a locking tongue extending towards the opening of the U-shape, and the locking tongue is used for abutting against the top surface of the linking part 24 to lock the elastic spout 23.

Preferably, on each of the first sidewall 223 and the second sidewall 224 is a positioning step 227. When the elastic spout 23 is in the folded storage state, the edge of the linking part 24 is placed on the positioning step 227. The positioning step 227 is used to define the depth at which the linking part 24 is rotated within the U-shaped structure 222.

When the limiting seat 22 and the lid body 21 are separate structures and are capable of being fixed to each other, on each of the first sidewall 223 and the second sidewall 224 are further provided with a guiding slot 229 communicated with the corresponding slideway 228 for mounting the guiding shaft 253. Each guiding slot 229 extends to a portion where its sidewall and the lid body 21 intersect. The guiding slot 229 facilitates the mounting of the guiding shaft 253 into the slideway 228, and the lid body 21 is provided with a limiting step 214 which inserts into the guiding slot 229. The limiting step 214 prevents the guiding shaft 253 moving from the guiding slot 229 when the lid body 21 is fixedly mounted with the limiting seat 22.

In order to improve the structural stability of the first, second and third sidewalls 223, 224, 225, a fixing plate 30 may be disposed on the limiting seat 22. The U-shaped structure 222 formed by the first, second and third sidewalls 223, 224, 225 is horizontally fixed on the fixing plate 30. Moreover, the U-shaped structure 222 and the fixing plate 30 may also be an integral structure. The area on the fixing plate 30 corresponding to the position of the storage area 226 is a hollow structure, which facilitates the installation and spares the elastic spout 23 and the vent hole 213. The outer edge of the fixing plate 30 may extend radially to the edge, or further extend downward to wrap the edge of the lid body 21, or at least partially wrap the edge of the lid body 21. The bottom surface of the fixing plate 30 and the top surface of the lid body 211 are fixed to each other to enhance the connection strength between the limiting seat 22 and the lid body 21.

In one embodiment, the elastic spout 23 is fixedly inserted into the through hole 212 of the lid body 21. The elastic spout 23 has a liquid inlet at one end thereof. The liquid inlet is fixedly inserted into the through hole 212 of the lid body 21, and the liquid inlet is closely adhered to the inner wall of the through hole 212 and may be further sealed by the sealing ring to improve the sealing property of the joint area. The elastic spout 23 has a liquid outlet at the other end. When the elastic spout 23 is in the folded storage state, the liquid outlet is obturated in the storage area 226. When the elastic spout 23 is in the release state, the liquid outlet is ejected from the storage area 226.

In one embodiment, the liquid inlet of the elastic spout 23 is further provided with a joint 232 adapted to the shape of the through hole 212 of the lid body 21. The joint 232 is clamped in the through hole 212 of the lid body 21. The joint 232 may be made of an elastic material and integrated with the elastic spout 23. The joint 232 and the elastic spout 23 may also be separate structures, and it is fixedly attached to the liquid inlet of the elastic spout 23 and abuts against the inner wall of the through hole 212. The joint 232 may enhance the tightness of the connection between the joint 232 and the inner wall of the through hole 212, and also enhance the firmness of insertion of the elastic spout 23 on the lid body 21, thus enhance the sealing performance of the container 100 as a whole.

Preferably, the joint 232 is inserted with a bottom inserting tube 234 extending toward the bottom of the container body 10, or the bottom inserting tube 234 and the elastic spout 23 are of a unitary structure. The bottom inserting tube 234 is used to drain the liquid at the bottom of the container body 10.

In one of the embodiments, at least one section of the elastic spout 23 is an elastic segment 231 for driving the elastic spout 23 to be unfolded. The elastic segment 231 closes the cavity by self-bending when the elastic spout 23 is in the folded storage state. The elastic segment 231 enables the elastic spout 23 to have a storage state that is relatively bent and a release state that is unfolded by its own elastic force.

In one embodiment, in the unlocked or release state, the portion of the elastic spout 23 exposing the lid body 21 is inclined with the axis of the lid body 21. The inclined elastic spout 23 and the top surface of the lid body 211 will form an obtuse angle. The elastic spout 23 and the top surface of the lid body 211 may be regarded as the two sides of the obtuse angle. The elastic spout 23 is folded towards the other side of the obtuse angle when it is bent, as shown in FIG. 1. Since the angle is an obtuse angle, the elastic spout 23 itself may obtain a larger deformation when bending. It enables the elastic spout 23 to provide a larger resilient force when the linking part 24 is released from the folded storage state with the locking part 221.

The anti-off head 233, the elastic segment 231, the joint 232 and the bottom inserting tube 234 of the elastic spout 23 may be of a unitary structure, or may be partially or entirely in a separate structure. When the elastic spout 23 is in a separate structure, the mutual components are fixedly connected, and the internal cavities connect with each other when in the unfolded state.

The elastic spout 23 is made of a silicone material. It may be understood that the elastic spout 23 may also be made of other elastic materials.

In one of the embodiments, the linking part 24 is connected to the liquid outlet of the elastic spout 23 and is rotatably connected to the elastic spout 23. The linking part 24 is disengaged from the interlocking state with the locking part 221 by its own deformation or by the movement of the guiding shaft 253 in the slideway 228.

In one embodiment, the linking part 24 is a cover plate. When the elastic spout 23 is in the folded storage state, the cover plate may block the liquid outlet of the elastic spout 23 to block dust or foreign matter, and keep the liquid outlet portion clean.

Of course, if the barrier function is not strictly required, the shape of the linking part 24 is not strictly limited, and may be, for example, a plate shape, a strip shape, or the like.

The cover plate as the linking part 24 is moved in the slideway 228 by the guiding shaft 253 to release from the interlocking state with the locking part 221. Preferably, the cover plate is sized to fit into the storage area 226 of the U-shaped structure 222. In the storage state, the cover plate is overlapped on the positioning step 227 of the U-shaped structure 222.

One side of the cover plate is provided with two connecting ears 242 disposed opposite to each other, and the cover plate is rotatably connected to the elastic spout 23 through the two connecting ears 242. When the fixing sleeve 25 is used, the opposite radial sides of the fixing sleeve 25 may be disposed with the rotating shaft 256, and the two connecting ears 242 are rotatably sleeved on the corresponding one of the rotating shafts 256 to realize the rotation cooperation of the cover plate and the fixing sleeve 25. The axis of the rotating shaft 256 is the second axis 252. It is also possible that the rotating shaft 256 is fixed on the two connecting ear 242, and a shaft hole is disposed on opposite radial sides of the fixing sleeve 25 for inserting a corresponding rotating shaft 256.

The side of the cover plate away from the third sidewall 225 (in the storage state) is directly or indirectly rotatably connected to the elastic spout 23, and the side of the cover plate adjacent to the third sidewall 225 (in the storage state) is provided with a bump 241 which protrudes to the third sidewall 225, wherein the bump 241 is used to cooperate with the locking tongue to lock the elastic spout 23 to the storage state. In the storage state, the top surface of the bump 241 is against the locking tongue.

It may be understood that in other embodiments, the locking form may have other structures, such as a protruding locking hook disposed on the outer edge of the third sidewall 225 of the limiting seat 22. Correspondingly, the linking part 24 extends to the third sidewall 225 and is provided with a hook portion that cooperates with the locking hook. The purpose of interlocking the linking part 24 and the locking part 221 may be achieved. The rotational connection between the linking part 24 and the elastic spout 23 (or the elastic spout 23 is indirectly driven by the fixing sleeve 25) facilitates the linking part 24 to directly or indirectly drive the elastic spout 23, and switch between the storage state and the release state for the elastic spout 23.

When in storage, the portion where the bump 241 first comes into contact with the locking tongue (the bottom edge of the bump 241 in the storage state) has a chamfered structure. When the bump 241 is guided to contact with the locking tongue through the inclined surface of the chamfered portion, the bump 241 slightly falls back. When the retreat happens, the back off space may be provided by the deformation of the cover plate itself or the movement of the guiding shaft 253 along the slideway 228. After the bump 241 is further pressed down over the locking tongue, the bump 241 extends below the locking tongue. That is, the locking tongue abuts the top surface of the bump 241 to keep in a locked state.

Similarly, a chamfered structure may be disposed on the locking tongue. That is, a portion where the locking tongue and the bump 241 first contact is formed with a slope, and the bump 241 is guided to be in position. The chamfered structures of both the locking tongue and the bump 241 may also be used in combination.

In one of the embodiments, the cover plate is provided with a force applying wrench 243 for driving the cover plate and the locking part 221 to release their interlocking state. The force applying wrench 243 facilitates the user to drive the cover plate.

In one of the embodiments, the container body 10 is generally cylindrical and has a recess on the side of the container body 10 for easy grip. In other embodiments, the structure of the container body 10 and the material of the container body 10 are not strictly limited, as long as it may be tightly connected with the lid 20 and may hold liquid. The container body 10 may be a vacuum container body 10 having a double-layer structure. The container body 10 may also be a container body 10 of a single layer structure.

In one embodiment, the handle 26 is located at the junction between the lid body 21 and the limiting seat 22, and is fixed by means of bonding or rotating shaft 256. The handle 26 is used to facilitate the user to carry the container 100 easily. Preferably, the handle 26 is a suspendable bracelet structure and is made of elastic silicone material. It will be appreciated that in other embodiments, the handle 26 may be made of other flexible materials, such as a string. The handle 26 may also be made of a hard material, such as plastic, in the shape of a handle.

Figure 2:
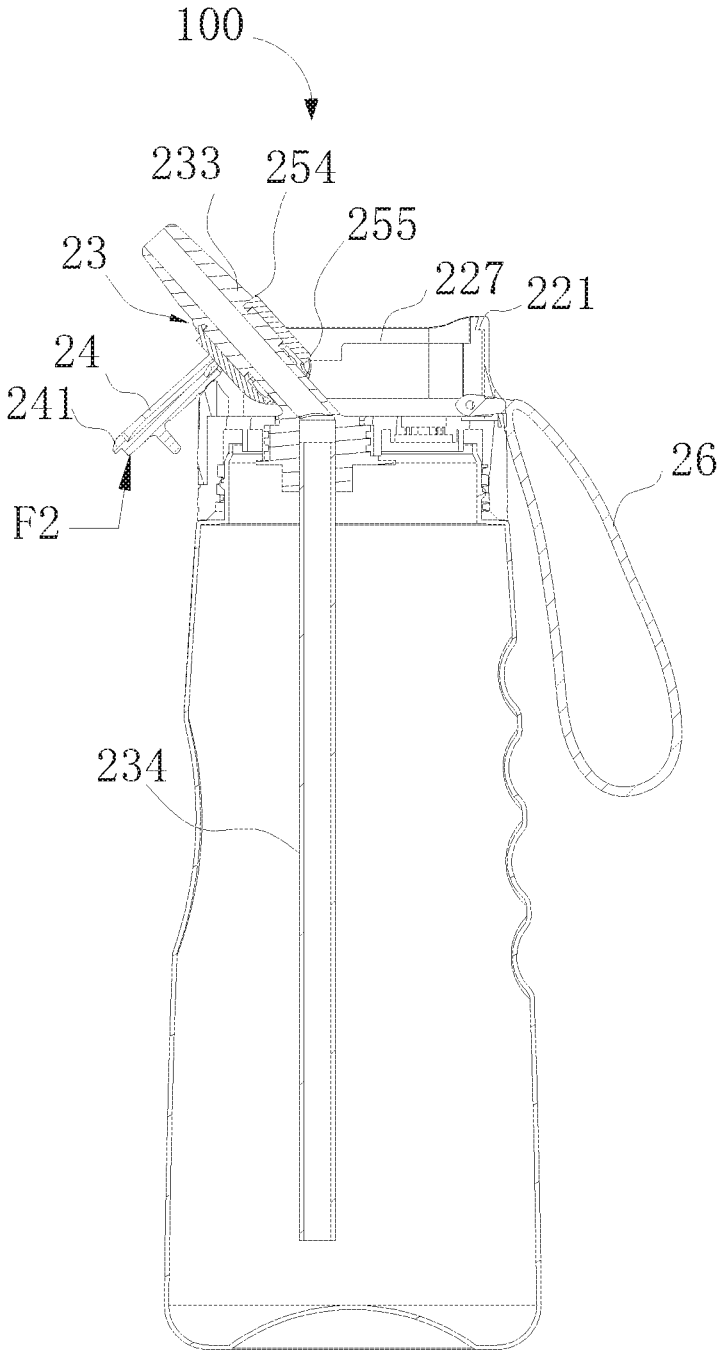
FIG. 2 is a cross-sectional view of the container shown in FIG. 1.

As shown in FIGS. 1 to 5, in a preferred embodiment, the working principle of the container 100 is as follows:

When the elastic spout 23 is in the unlocked or released state, the user applies force on the linking part 24 (cover plate) or the force applying wrench 243 by the force application direction F2 as shown in FIG. 2. When the cover plate and the fixing sleeve 25 are in close contact with each other, the cover plate is further pushed to drive the fixing sleeve 25 to turn over around the guiding shaft 253. The elastic segment 231 of the elastic spout 23 is folded along the bottom edge 255 of the fixing sleeve 25 to close the cavity, and the bottom edge 255 of the fixing sleeve 25 abuts the elastic segment 231 being contacted away from the locking part 221 (locking tongue). The anti-off head 233 of the elastic spout 23 overlaps the fixing sleeve 25. The top edge 254 of the fixing sleeve 25 pull the anti-off head 233 of the elastic spout 23 to stretch towards the locking tongue. The elastic segment 231 is stretched in two opposite directions and is in a tension state. The fixing sleeve 25 overcomes the elastic force of the elastic spout 23 to enable the elastic spout 23 to fold. The degree of stretch of the elastic segment 231 increases, as the rotation angle of the fixing sleeve 25 increases, and the tension of the elastic segment 231 is enhanced. While the fixing sleeve 25 is turned over, the tensioned elastic segment 231 pushes the fixing sleeve 25 to shift to the locking tongue. That is, the guiding shaft 253 in the slideway 228 is driven to slide towards the locking part 221, further pulling the bump 241 on the cover plate move towards the locking tongue. When the bump 241 abuts the locking tongue, the cover plate is pressed hard to clamp the bump 241 into the locking tongue, and the tensioned elastic segment 231 drives the top surface of the bump 241 to abut the locking tongue and remain in the interlock state. That is, the elastic spout 23 is returned to the storage area 226 and is in a folded storage state, the elastic segment 231 closes the cavity by bending itself to prevent liquid from leaking out of the elastic spout 23.

Figure 3:
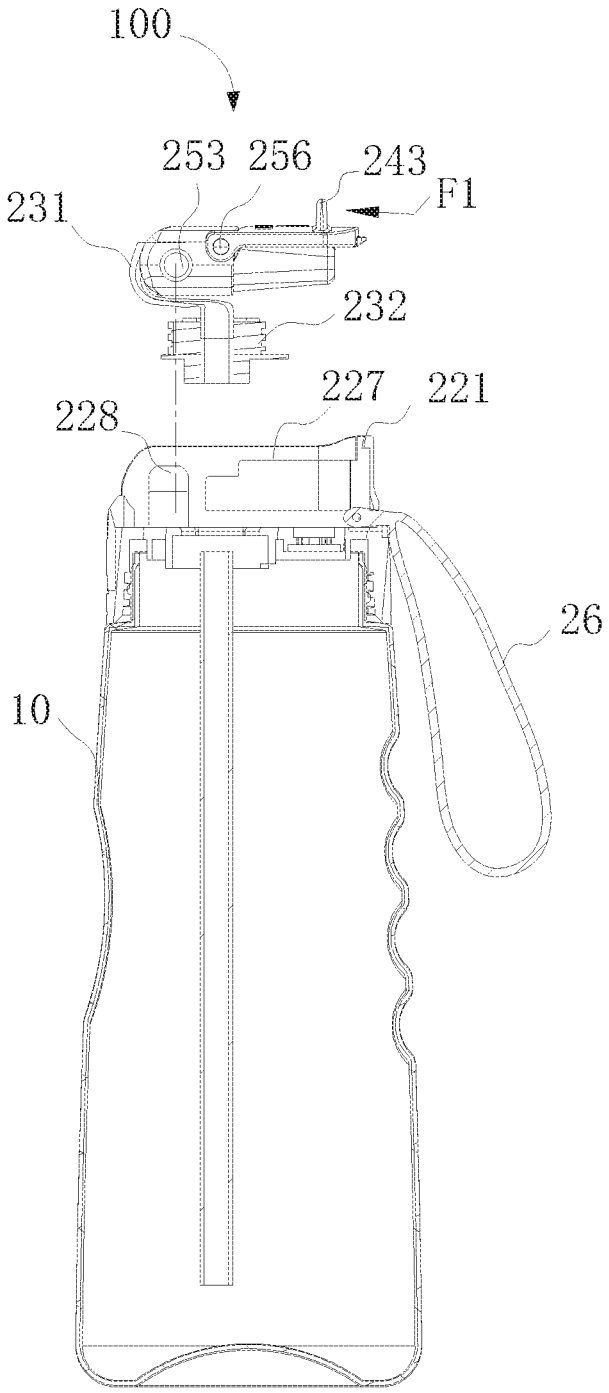
FIG. 3 is an exploded view of the container shown in FIG. 1 in the storage state.
Figure 4:
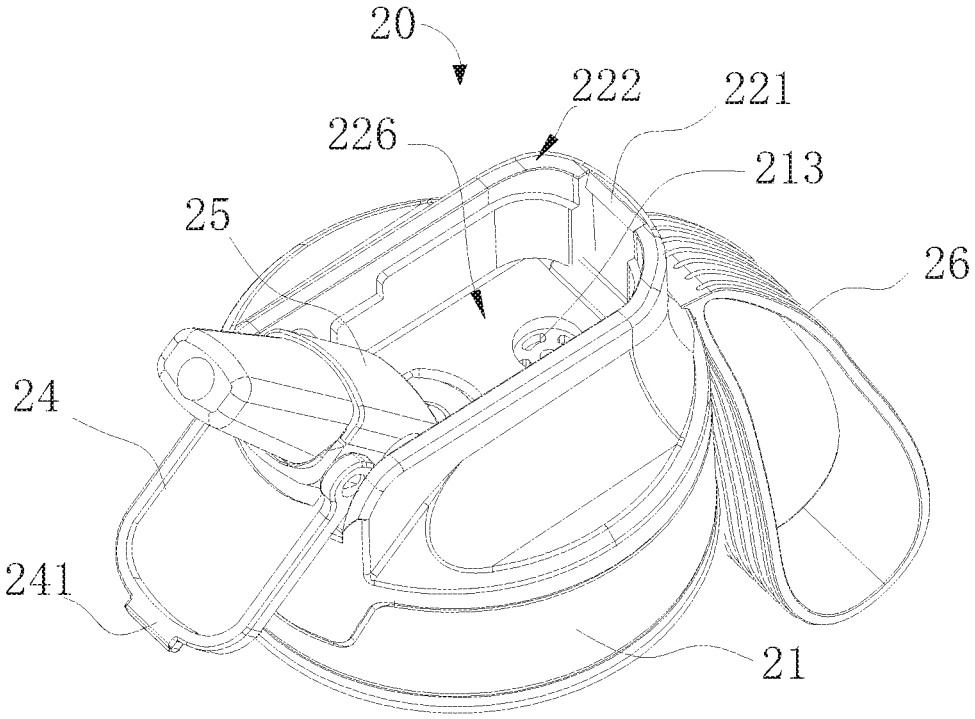
FIG. 4 is a perspective view of a lid of the container shown in FIG. 1.
Figure 5:
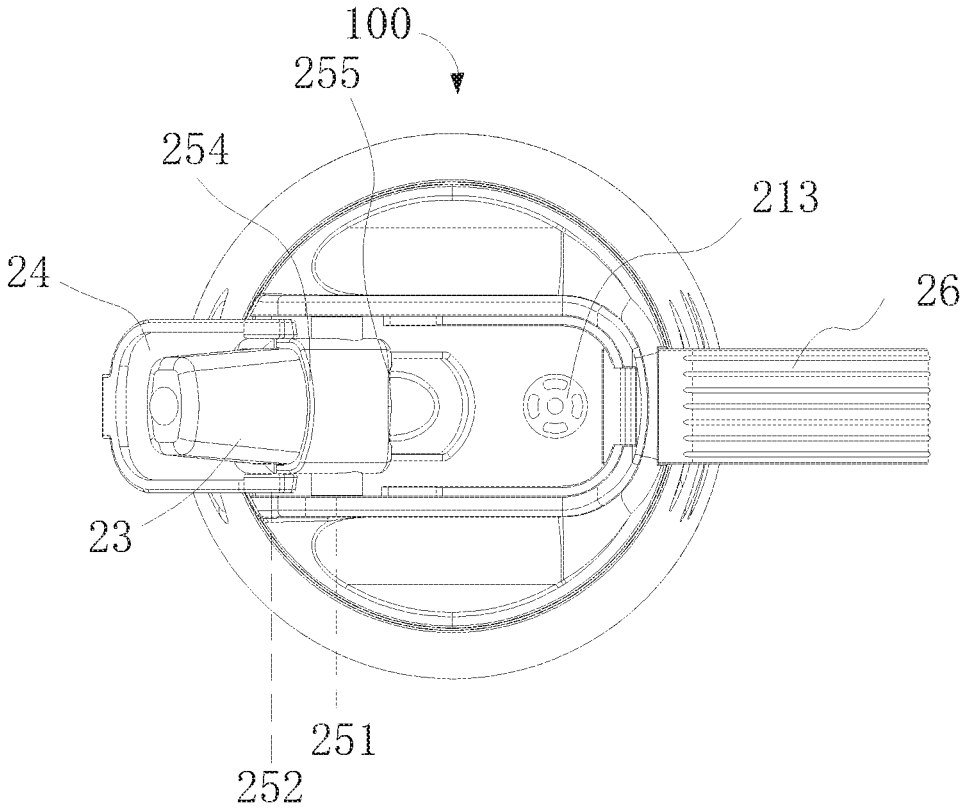
FIG. 5 is a top view of the container shown in FIG. 1.
Figure 6:
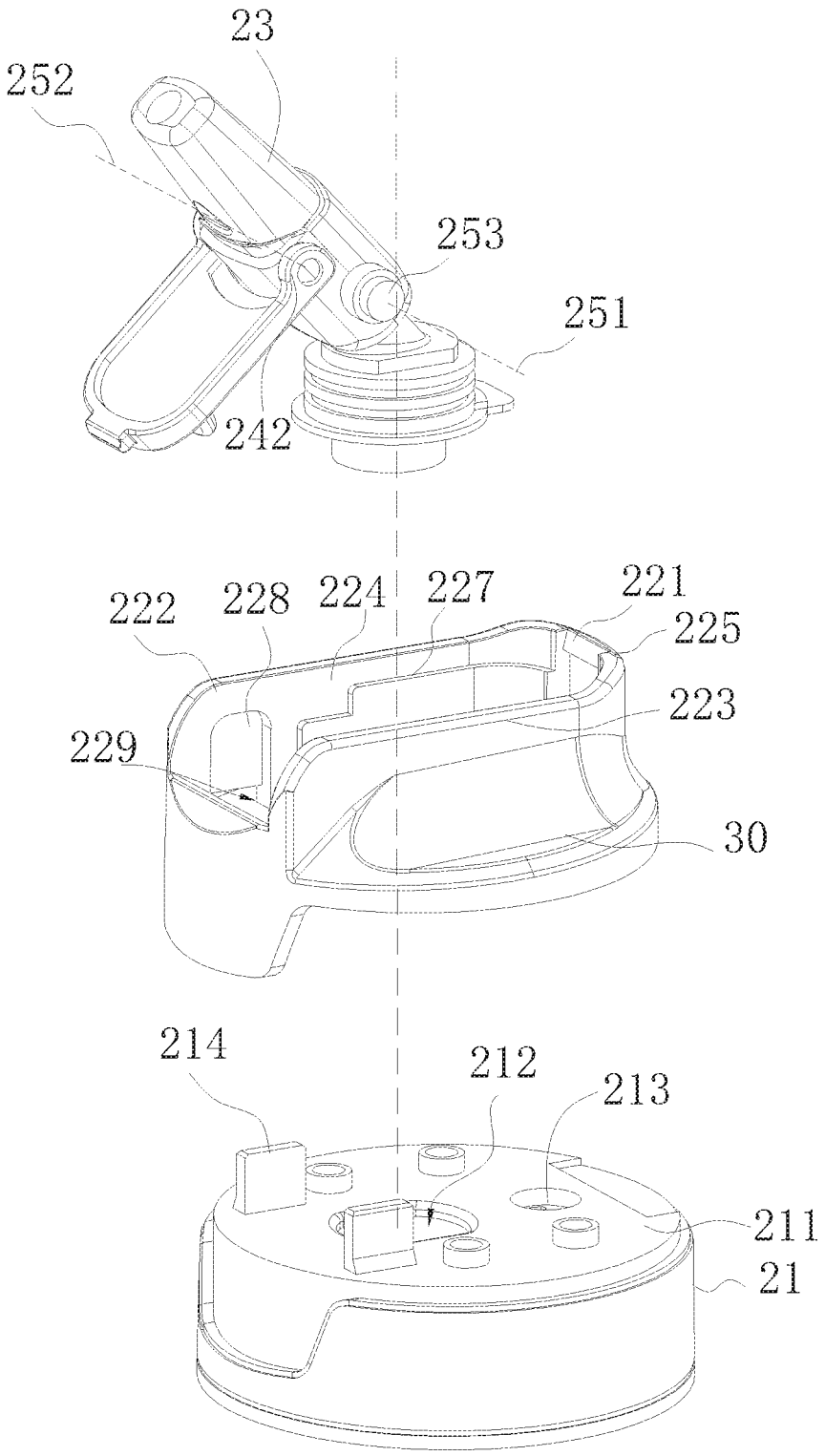
FIG. 6 is an exploded view of the lid shown in FIG. 4.

When the elastic spout 23 is in the storage state, the user pushes the force applying wrench 243 by the force application direction F1 as shown in FIG. 3, and then drives the cover plate to move in this direction. The cover plate drives the guiding shaft 253 on the fixing sleeve 25 to slide away from the locking tongue in the slideway 228, and drives the driving sleeve 25 and the elastic spout 23 to move away from the locking tongue. That is, the cover plate overcomes the elastic force of the elastic spout 23 itself until the cover plate completely comes out the abutment area with the locking tongue. The top surface of the cover plate is unlocked with the locking tongue. At this time, the bent elastic segment 231 is straightened due to that the deformation is restored by its own elasticity, and the fixing sleeve 25 on the elastic spout 23 is turned over, thereby the liquid outlet of the elastic spout 23 is ejected from the storage area 226. The elastic spout 23 is then in the unlocked or release state. That is, the elastic segment 231 is in the unfolded state, and the cavity of the elastic segment 231 is opened. The user may drink the liquid in the cup 100 through the elastic spout 23.

The embodiment of the present disclosure provides a container 100. The container 100 is configured to lock and release the elastic spout 23 by providing cooperation between the linking part 24, the elastic spout 23 and the limiting seat 22, so as to make the elastic spout 23 of the container 100 safer and more sanitary in installation and operation. The container 100 as a whole is easy to use and clean, and the service life of the container 100 may be extended accordingly.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A container, comprising a lid and a container body connected to the lid, the lid comprising a lid body, an elastic spout extending away from the lid body and a limiting seat mounted at a top of the lid body; a linking part is mounted on the elastic spout, and a locking part cooperating with the linking part is disposed on the limiting seat;

the elastic spout has a folded storage state, and the linking part and the locking part are interlocked with each other in the folded storage state;

the elastic spout further has a release state in which the linking part is disengaged from the locking part to enable the elastic spout to be unfolded.

2. The container according to claim 1, wherein the elastic spout is provided with a fixing sleeve rotatably mounted on the lid body, and the linking part is rotatably mounted on the fixing sleeve.

3. The container according to claim 2, wherein the limiting seat is provided with a slideway, an outer wall of the fixing sleeve is provided with a guiding shaft rotatably and slidably mounted in the slideway;

the linking part is released from the locking part by a movement of the guiding shaft in the slideway.

4. The container according to claim 3, wherein two slideways are oppositely disposed, and two guiding shafts are respectively and slidably disposed in each of the slideways, and the two guiding shafts are disposed coaxially on radial sides of the fixed sleeve.

5. The container according to claim 3, wherein the limiting seat has a U-shaped structure that is horizontally fixed on the top surface of the lid body, and includes a first sidewall, a second sidewall and a third sidewall, the first sidewall and the second sidewall are oppositely disposed, and the third sidewall is connected between the first sidewall and the second sidewall, the two slideways are respectively disposed adjacent to the first sidewall and the second sidewall, the locking part is disposed at the third sidewall, and the elastic spout is mounted within an enclosed area surrounded by the U-shaped structure.

6. The container according to claim 5, wherein on each of the first sidewall and the second sidewall are further provided with a positioning step, and the edge of the linking part is placed on the positioning step when the elastic spout is in the folded storage state.

7. The container according to claim 5, wherein the limiting seat and the lid body are separated structures and are capable of being fixed to each other, on each of the first sidewall and the second sidewall are further provided with a guiding slot communicated with the corresponding slideway for mounting the guiding shaft, the respective guiding slots extend to a portion where the sidewall intersects with the lid body.

8. The container according to claim 3, wherein the elastic spout includes a liquid inlet at an end and a liquid outlet at another end, the end with the liquid inlet is fixed to the lid body, the other end with the liquid outlet pierces through the fixing sleeve and an anti-off head subject to the fixed sleeve is disposed at the piercing portion.

9. The container according to claim 8, wherein the linking part is a cover plate, and the cover plate blocks the liquid outlet of the elastic spout when the elastic spout is in the folded storage state; the cover plate is provided with a force applying wrench for driving the cover plate and the locking part to release the interlocking state.

10. The container according to claim 8, wherein a rotation axis of the guiding shaft and a rotation axis of the linking part are parallel and offset from each other; the rotation axis of the linking part is closer to the liquid outlet of the elastic spout, compared to the rotation axis of the guiding shaft.

11. The container according to claim 8, wherein at least one section of the elastic spout is an elastic segment for driving the elastic spout to be unfolded, and the elastic segment closes the cavity by self-bending when the elastic spout is in the folded storage state.

12. The container according to claim 11, wherein one side of the fixing sleeve adjacent to the liquid outlet is a top edge and the anti-off head abuts the top edge, the other side of the fixing sleeve is a bottom edge, the elastic segment is bent around the bottom edge of the fixing sleeve and is in a tension state in the folded storage state; the elastic segment in the tension state drives the linking part and the locking part to be in the interlocked state.

13. The container according to claim 1, the locking part is a locking tongue that is abutted against the top surface of the linking part when being interlocked.

* * * * *